US007411559B2

(12) United States Patent
Leinonen et al.

(10) Patent No.: US 7,411,559 B2
(45) Date of Patent: Aug. 12, 2008

(54) HEADSET LOOP ANTENNA

(75) Inventors: Marko Leinonen, Oulu (FI); Marko Autti, Oulu (FI)

(73) Assignee: Nokia Corporation, Espoo (FI)

( * ) Notice: Subject to any disclaimer, the term of this patent is extended or adjusted under 35 U.S.C. 154(b) by 60 days.

(21) Appl. No.: 10/880,290

(22) Filed: Jun. 29, 2004

(65) Prior Publication Data

US 2005/0285799 A1 Dec. 29, 2005

(51) Int. Cl.
*H01Q 1/24* (2006.01)

(52) U.S. Cl. ..... 343/718; 343/744; 343/870; 455/575.7

(58) Field of Classification Search ..... 343/702, 343/720, 905, 906, 718, 741, 744, 866, 870; 455/269, 41.2, 575.2, 575.6, 575.7; 379/430
See application file for complete search history.

(56) References Cited

U.S. PATENT DOCUMENTS 2,475,641 A * 7/1949 Rosenberg ..... 348/722
5,438,698 A * 8/1995 Burton et al. ..... 455/351
5,757,332 A * 5/1998 Hanaoka et al. ..... 343/787
6,008,761 A 12/1999 Harano ..... 343/366
6,456,246 B2 9/2002 Saito ..... 343/702
6,597,320 B2 7/2003 Maeda et al. ..... 343/718
6,856,288 B2 * 2/2005 Apostolos et al. ..... 343/700 MS

FOREIGN PATENT DOCUMENTS

JP 58-108879 * 6/1983

* cited by examiner

*Primary Examiner*—Michael C Wimer
(74) *Attorney, Agent, or Firm*—Harrington & Smith, PC

(57) ABSTRACT

A headset has a first and an optional second earpiece 12, 16 respectively coupled to a plug 30 via first and an optional second conductors 14, 20, 18, 22. An antenna loop section 36 has a first loop section 31 at least partially bound to a portion of the first conductor 20, and a second loop section 33 bound to at least a portion of the second conductor 22. Where bound, the first conductor and first loop section may be coaxial or side-by-side. The loop sections include inductors 42,44, and the conductors include ferrite rings 38,40 near the earpieces. A connector 24 mechanically holds the first and second conductors in proximity to one another, and also includes a conductive bridge 34 to electrically couple the first and second loop segments, which may be via a contact connection or a capacitive connection. Audio and RF signals are separated by frequency in a device 50 to which the headset is coupled.

15 Claims, 7 Drawing Sheets

HEADSET LOOP ANTENNA

FIELD OF THE INVENTION

The present invention generally relates to a loop antennas for radio frequency (RF) signal reception, and is particularly directed to an antenna coupled to a headset that is particularly advantageous for receiving digital video broadcast signals and other broadband signals.

BACKGROUND

Portable electronic devices such as broadcast radio receivers and radiotelephones are continually driven to smaller sizes while offering better performance and more varied features. One engineering challenge in continual size reduction has been improved antenna designs to ensure a reliable and efficient communications interface between the portable device and other entities with which it communicates. Antennas serve to transition an energy signal between circuitry and a wireless channel. The effectiveness of energy transfer between an antenna and its adjacent circuitry is dependent on the terminal impedance of the antenna and that of the adjacent circuit over the desired frequency range.

The directive properties of some antennas, exhibited as a non-uniform radiation pattern, give rise to the concept of antenna gain. Gain is the measure of radiation intensity in a given direction as compared to radiation intensity if the radiation pattern were uniform in all directions. Gain is principally dependent upon the size of an antenna, generally expressed in wavelengths. The gain is measured either on a linear scale or logarithmically in decibels. Larger antennas generally exhibit higher gain. When one or more dimensions of an antenna is significantly larger than a wavelength, its radiation pattern defines a lobe structure, generally with one or more maximums flanked by sidelobes. Maximizing the lobe structure for the intended reception has led to many different configurations for antennas.

A loop antenna has one or more closed conductive pathways, and sometimes a fixed or variable capacitor coupled to the terminals or in series along the conductor of the loop to tune the antenna to resonance. Loop antennas are desirable for their broadband capabilities, a regime in which portable devices are entering using a standard entitled digital video broadcast for handheld devices (DVB-H). Loop antennas are directional, exhibiting radiation patterns with a very large main lobe and a high gain in the direction of that main lobe. By their nature, portable electronic devices are suited to non-directional antennas, since a tower with which the portable device communicates may or may not be aligned with the main lobe of a directional antenna at any given time. Efficiency in a loop antenna is proportional to the area of the loop. In the prior art, a loop antenna no larger than the size of a handheld device results in a very inefficient antenna, which needs additional lossy matching circuits and increases necessary signal processing in the portable device and adds cost while simultaneously reducing battery life.

What is needed in the art is a broadband antenna that is sufficiently small and lightweight for use with a portable device, and that exhibits good reception properties over a broadband frequency range with acceptable efficiency.

SUMMARY OF THE INVENTION

This invention is in one aspect a headset having a first earpiece, a first conductor that is electrically coupled to the first earpiece, and a conductive loop. The first conductor provides an audio signal to the earpiece. The conductive loop has a first loop segment that is mechanically bound to at least a portion of the first conductor. Preferably, the headset further includes a similar second earpiece and second conductor, and at least a portion of the second loop segment is mechanically bound to at least a portion of a second loop segment of the conductive loop. The conductive loop may be used as a RF receiving antenna and is particularly advantageous for receiving wireless digital video broadcast (DVB-H) signals. Further implementation details are described below.

In another aspect of the invention is a headset that has at least one earpiece coupled to a plug by a conductor, where the improvement includes a conductive loop having a loop segment that is made in one piece with at least a portion of the conductor. Preferably, the headset has a second earpiece coupled to the plug by a second conductor, and a separate second loop segment of the conductive loop is made in one piece with the second conductor.

In yet another aspect of the invention is a method to convert a radiofrequency RF signal to an output signal. The method begins with receiving a RF signal at a loop antenna that is made at least in part in a headset wire, and passing the received RF signal to a portable electronic device via a plug that removably couples the loop antenna to the portable electronic device. Further in accordance with the method, the RF signal is converted in the portable electronic device to an output signal. The output signal may be an audio, video, or audio/video signal, and is preferably sent to a transducer via the plug and headset wire, where at least a portion of the headset wire is mechanically bound to at least a segment of the loop antenna.

In yet another embodiment, the invention is a device for receiving a wireless RF signal, the device having a headset and a receiver. The headset is characterized in that a first earpiece houses a first speaker, a first conductor has a first end coupled to the first earpiece, and a plug coupled to an opposed second end of the first conductor. The plug is for removably coupling to the receiver. Also included in the headset is a loop antenna disposed between the first earpiece and the plug. The receiver is characterized in that it has a receptacle for removably receiving the plug, and has means to convert a RF signal from the loop antenna to an output signal, such as an audio or video signal, that is output to the first conductor.

These and other features, aspects, and advantages of embodiments of the present invention will become apparent with reference to the following description in conjunction with the accompanying drawings. It is to be understood, however, that the drawings are designed solely for the purposes of illustration and not as a definition of the limits of the invention.

DETAILED DESCRIPTION

The present invention incorporates a loop antenna into a headset to improve reception in a portable electronic device that provides the signals to the headset. Important to understanding why the invention is effective is that a loop antenna reacts to the magnetic field component of an electromagnetic wave rather than the electric field component. On the other hand, a human body can be approximately deemed as a conductor. In the vicinity of a human body, the electric field is weakened because of an electric image, but the magnetic field is conversely strengthened. Therefore, the antenna characteristics of a loop antenna, when used in the vicinity of a human body are superior to those in the case where the antenna is used in another place. Exploiting this aspect allows the loop antenna of the present invention to deliver enhanced results, as will be quantified in FIG. 5*a* below.

A headset as used herein is any apparatus intended to be worn on or supported by a user's head that holds at least one speaker or other transducer in the vicinity of the user's ear. Common headsets include an apparatus with speakers in each of two ear cups that are joined by an arcuate support that lies over or behind a persons head (e.g., Bose aviation headset X), and an apparatus with one or two speakers that are fashioned to be inserted into a person's ear canal or supported adjacent to the ear canal by a support arm that overlies the ear adjacent to a person's head (e.g, Nokia headset models HS-10, HDS-3, HS-5). An earpiece is that portion of the headset that houses the speaker or other transducer.

Figure 1A:
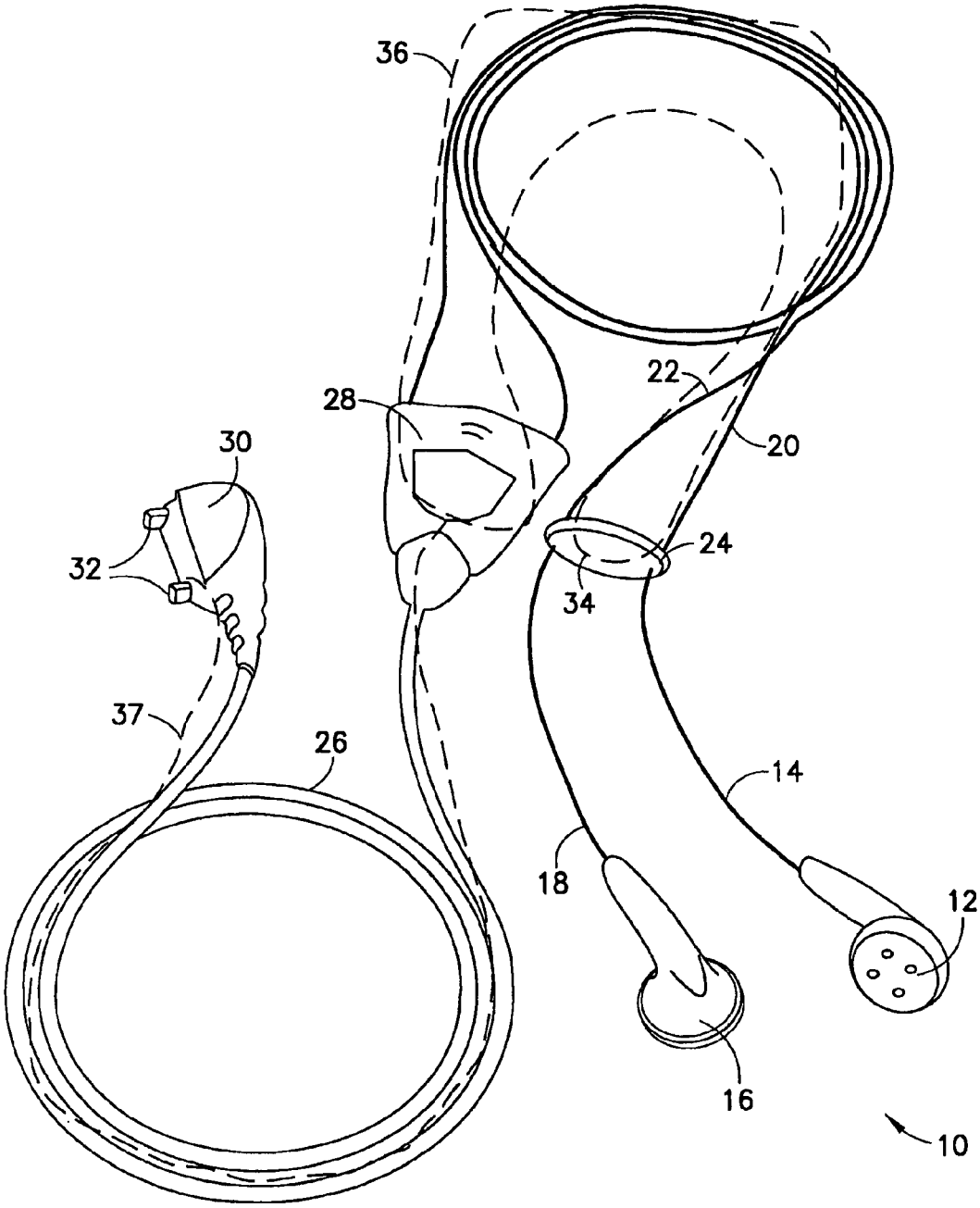
FIG. 1*a* is a perspective view of a headset for a portable device incorporating the inventive loop antenna, the antenna shown as an overlay over the prior art headset.
Figure 1B:
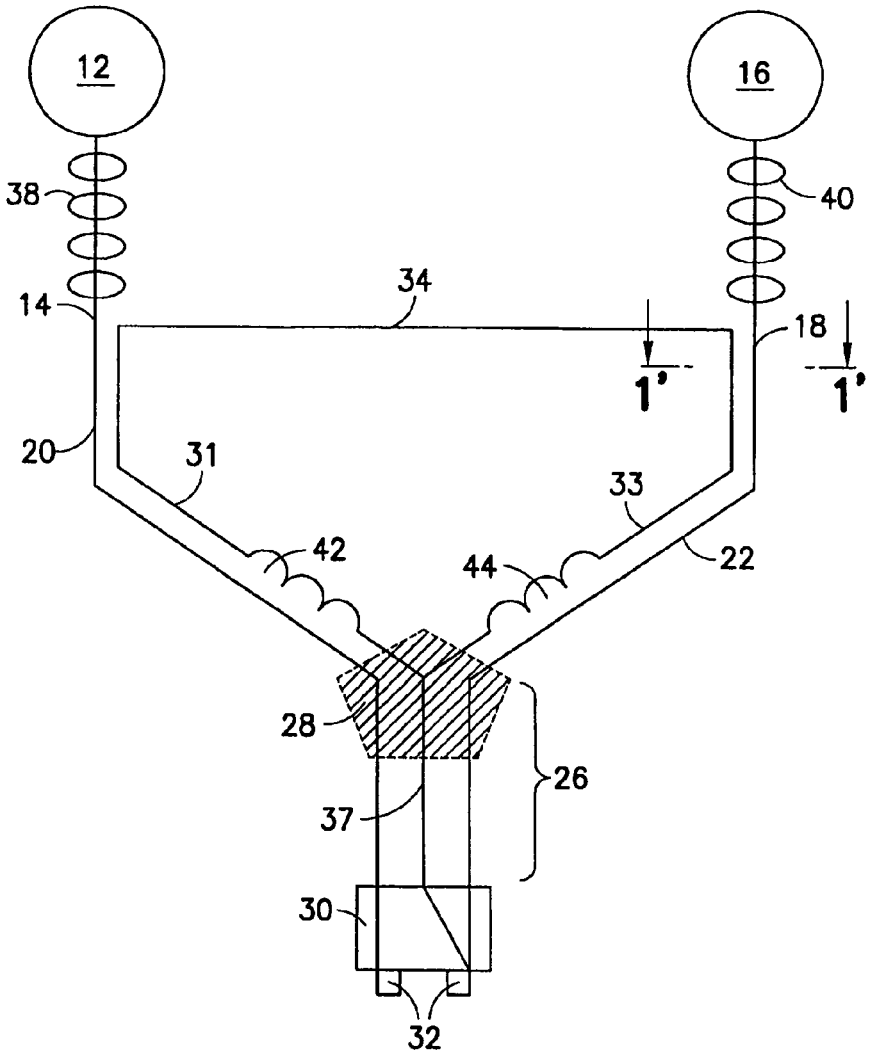
FIG. 1*b* is a schematic diagram of the headset of FIG. 1 incorporating the inventive loop antenna.

The preferred embodiment of the present invention is shown in perspective view at FIG. 1*a*, and in block diagram form at FIG. 1*b*. FIG. 1*a* is a view of a Nokia model HDS-3 stereo headset, with an overlay of a conductive pathway that forms the inventive loop antenna that is not present in the prior art version of that model headset. That prior art headset will be first described, followed by the inventive antenna, to better distinguish the invention. In accordance with FIGS. 1*a* and 1*b*, a headset 10 includes a first earpiece 12 coupled to a first upper 14 conductor, and a second earpiece 16 coupled to a second upper conductor 18. The first upper conductor 14 is coupled to, or preferably is made in one piece with, a first lower conductor 20. Similarly, the second upper conductor 18 is coupled to or made in one piece with a second lower conductor 22. The upper and lower conductors are separated by a connector 24 that retains the first and second conductors within a maximum distance from one another, at least in the area of the connector 24. In the prior art HDS-3 headset, the connector 24 is a mechanical only coupling of the first and second conductors, and is slideable to allow a user to move the connector 24 nearer his/her neck or chin to minimize large moments on the upper conductors 14, 18 that may tend to dislodge the earpieces 12, 14 from the user's ear canal. It may also be used to position a microphone in the y-type coupler 28 near to the user's mouth for hands free operation of a radiotelephone to which the headset 10 may be attached.

The first and second lower conductors 20, 22 are gathered together within a common protective sheath at a bundled conductor section 26 via a y-type coupler 28. The y-type coupler 28 may be merely a mechanical cover, or may preferably also include electronic circuitry such as a microphone for hands-free operation of a radiotelephone to which the headset 10 is electrically coupled and an answer button to answer calls incoming to that radiotelephone. Such features are available on the prior art model HDS-3. The bundled conductor section 26 terminates in a plug 30 or receptacle defining contacts 32, each of which couple either the first 12 or second 16 earpieces electrically to a separate portable device.

In accordance with the present invention, an antenna that includes an antenna loop section 36 and an antenna lead 37 is made a part of the headset. Further details of electrical aspects of the preferred embodiment of the invention are shown schematically in FIG. 1*b*, wherein the antenna loop section 36 is bounded by a first 31 and second 33 antenna loop sections, the coupler 28, and the conductive bridge 34. Along the first upper conductor 14 and between the bridge 34 and the first earpiece 12 is disposed a first ferrite ring 38. A second ferrite ring 40 is disposed similarly along the second upper conductor 18. These ferrite rings do not enhance or degrade from the performance of the inventive loop antenna, but rather block radiofrequency signals from being transferred to the transducers within the earpieces 12, 16. Preferably, the ferrite rings 38 are disposed within a housing that holds the transducers or speakers so as not to dislodge the earpiece from a user's ear canal when a user moves his/her head. The ferrite rings 38 and 40 can be positioned permanently or slide able close to connector 24 to reduce matching effect of conductors 14 and 18.

A first inductor 42 is disposed along the first antenna loop section 31 between the bridge 34 and the coupler 28. Preferably, the first inductor 42 is adjacent the coupler 28 and maximally spaced from the bridge 34 along the first antenna loop section 31. A second inductor 44 is similarly disposed along the second antenna loop section 33, and preferably each inductor 42, 44 defines a like impedance. Preferably the first 31 and second 33 antenna loop segments are coupled to one another and to a conductive antenna lead section 37 at the y-type coupler 28, though in certain embodiments they may join directly at the plug 30. While each of the first 42 and second 44 inductors preferably exhibit like inductance, each inductor 42,44 is a matching element in that it is matched to the desired reception frequency of the loop antenna.

Where the headset 10 includes only one earpiece (e.g., the first earpiece 12), the second upper 18 and lower 22 conductors are not present and the second loop segment 33 is structurally supported by suspension from the first earpiece 12 or preferably from a clip attached to a user's clothing. In such an embodiment, the antenna loop section 36 may be a continuous conductive wire with or without inductors 42,44 as opposed to the above-described loop segments 31, 33 coupled by a distinct conductive bridge 34. Alternatively, such a single-earpiece embodiment may include the conductive bridge 34 to allow sliding, enabling expansion and contraction of the antenna loop.

Figure 1C:
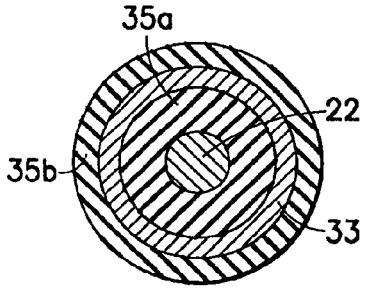
FIGS. 1*c* and 1*d* are sectional views taken along line 1'-1' of FIG. 1*b* for different embodiments of the present invention.
Figure 1D:
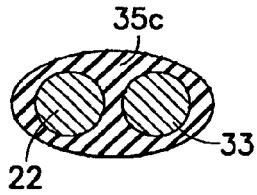

Two distinct embodiments of the antenna loop section 36 are detailed at FIGS. 1*c* and 1*d*, which are sectional views taken along line 1'-1' of FIG. 1*b*. In a preferred first embodiment of FIG. 1*c*, the second lower conductor 22 that carries the audio signal to the earpiece 16, and the second loop segment 33 that serves as a portion of the antenna loop 36, are coaxial. Preferably, the second lower conductor 22 is a centrally disposed metal wire and the second loop segment 33 is a conductive sheath about the central wire. In one aspect of this embodiment, the second loop segment is a conductive plastic sheath. Conductive plastics and polymers are known in the art (see, for example, U.S. Pat. Nos. 4,204,216; 4,222,903; and 5,556,700), and now commonly used as antenna material for mobile radiotelephones and other portable devices when the antenna is external and resiliency is desirable. As depicted in FIG. 1*c*, additional electrically insulating layers 35*a*, 35*b* may be added to the embodiment of FIG. 1*c*, such as an electrically insulating layer 35*a* disposed between the two depicted layers 22, 33 to insulate the two depicted conductors 22, 33 from one another, and an exterior ground shielding layer 35*b* about the entire cross section to prevent current loss and battery drawdown that may occur when a user's skin is in contact with a conductive sheath. The former layer 35*a* is not necessary to operation of the invention, as the audio signal and the antenna signal are easily separable in the frequency domain. The latter layer 35*b* is also unnecessary as the target signals to be received by the antenna loop section 36 are in a frequency range that is only minimally attenuated by such an insulating layer.

In an alternative embodiment depicted in FIG. 1*d*, the second lower conductor 22 and the second antenna loop section 33 are disposed adjacent to one another, preferably within a common sheathing 35*c* that is electrically insulating.

Considering again FIGS. 1*a* and 1*b*, the conductive bridge 34 is preferably disposed within the mechanical connector 34. Conduction between the first 31 and second 33 antenna sections, using either embodiment described, may be a mechanical contact connection or a capacitive connection wherein the first 31 and second 33 antenna loop sections by means of the radio signals propagating through them without the antenna loop sections 31, 33 being in physical contact with one another. In either embodiment, the mechanical connector may be slideable, causing the effective size of the antenna loop section 36 to change: the former without physically changing the measured length of the loop sections 31, 33; and the latter by changing the measured length of the loop sections 31, 33. However, maintaining an antenna loop section 36 with a constant effective size provides for more stable RF reception.

Preferably, the antenna loop section 36 is coupled to one of the contacts 32 of the plug that also couples with the first 20 or second 22 lower conductor. Alternatively, such as with the embodiment of FIG. 1*d*, the conductive lead 37 is coupled to a third contact (not shown) that maintains spatial separation of the signal received at the loop antenna section 36 and the audio signal that passes through the first 20 and second lower conductors. The loop section 36 can be routed separately with wire 37 to plug 32 and the plug 32 may have its own signal connectors for the radio reception signal.

Figure 2B:
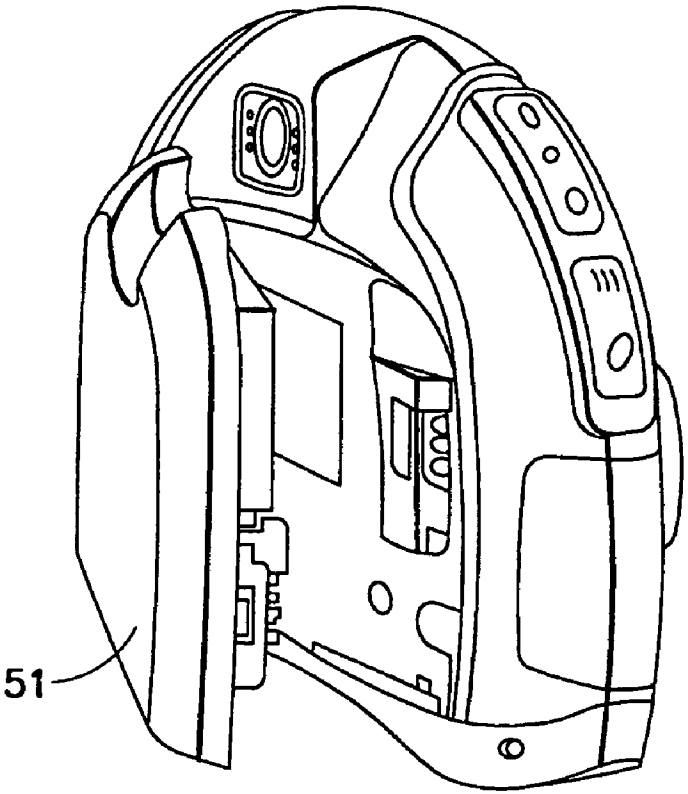
FIG.2b PRIOR ART
FIGS. 2*a* and 2*b* are plan and perspective views, respectively, of a wireless portable device in which reception is enhanced by use of the inventive headset of FIG. 1*a*.
Figure 2A:
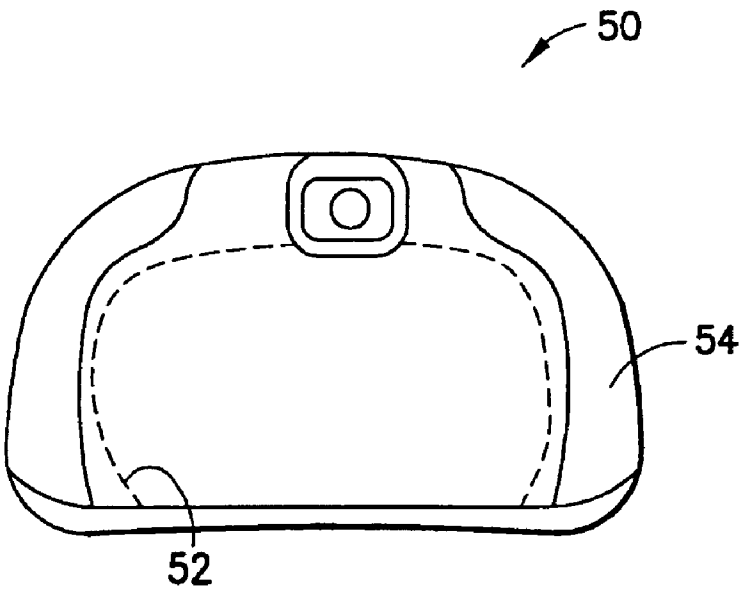
FIG.2a PRIOR ART

Typically, amplifiers disposed within a portable device 50 to which the headset 10 is attached, such as that shown in prior art FIGS. 2*a* and 2*b*, drive the audio signal to the earpieces 12, 16. Where the signal from the antenna loop section 36 is mixed with the audio signal, the present invention contemplates de-coupling, within the portable device 50, the RF signals received at the loop antenna section 36 from the audio signals by means of capacitors. Such de-coupling is straightforward as the RF signals and the audio signals are widely separated in the frequency domain. Frequency-selective filters are known in the art, though the inventors are unaware of filtering by frequency a signal received at a loop antenna that is input into a portable device via a headset jack or receptacle for a headset plug. Frequency de-coupling allows the existing amplifiers in the portable device 50 to continue to drive the transducers directly without overpowering the RF signal received from the antenna loop section 36. Where the antenna loop section 36 is coupled via a conductive lead 37 that is not conductively coupled to either of the first 20 or second 22 lower conductors (e.g., the conductive lead 37 is tapped into a third plug contact 32, not shown, and the signals remain spatially segregated), performance of the loop antenna section 36 may be enhanced but at a greater fabrication and implementation cost.

FIGS. 2*a*-2*b* are prior art plan and perspective views, respectively, of the Nokia model 7700 media device 50 with which the present inventive loop antenna headset 10 is particularly advantageous. In addition to other features, the model 7700 media device 50 is capable of wirelessly receiving digital video broadcasts using the evolving DVB-H standard (Digital Video Broadcast for Handheld devices) using an add-on module 51. Like many prior art portable devices that seek to employ a loop antenna, the model 7700 media device 50 fixes an internal loop antenna 52 (shown in FIG. 2*a* as an overlay) to a housing 54 of the add-on module 51. However, portable devices are generally more desirable to consumers when their size is not obtrusive, so the size of an internal loop antenna 52, and its resulting performance, is limited by competing business considerations. The model 7700 measures about 13×8 cm along its largest face. Other portable devices are generally in that size range and historical trends indicate device size will continue to constrict. Because the DVB-H standard operates over a wide frequency range, the prior art internal loop antenna 52 cannot optimize reception over the entire range. The reception signal level is related to how well the antenna is tuned and the size of the antenna loop. Adapting a headset 10 with the antenna loop section 36 as described above provides a larger antenna loop than what is reasonably attainable by disposing a loop antenna within a commercially viable portable electronic device. The inductors 42, 44 tune the inventive antenna to the desired frequency range.

Figure 3A:
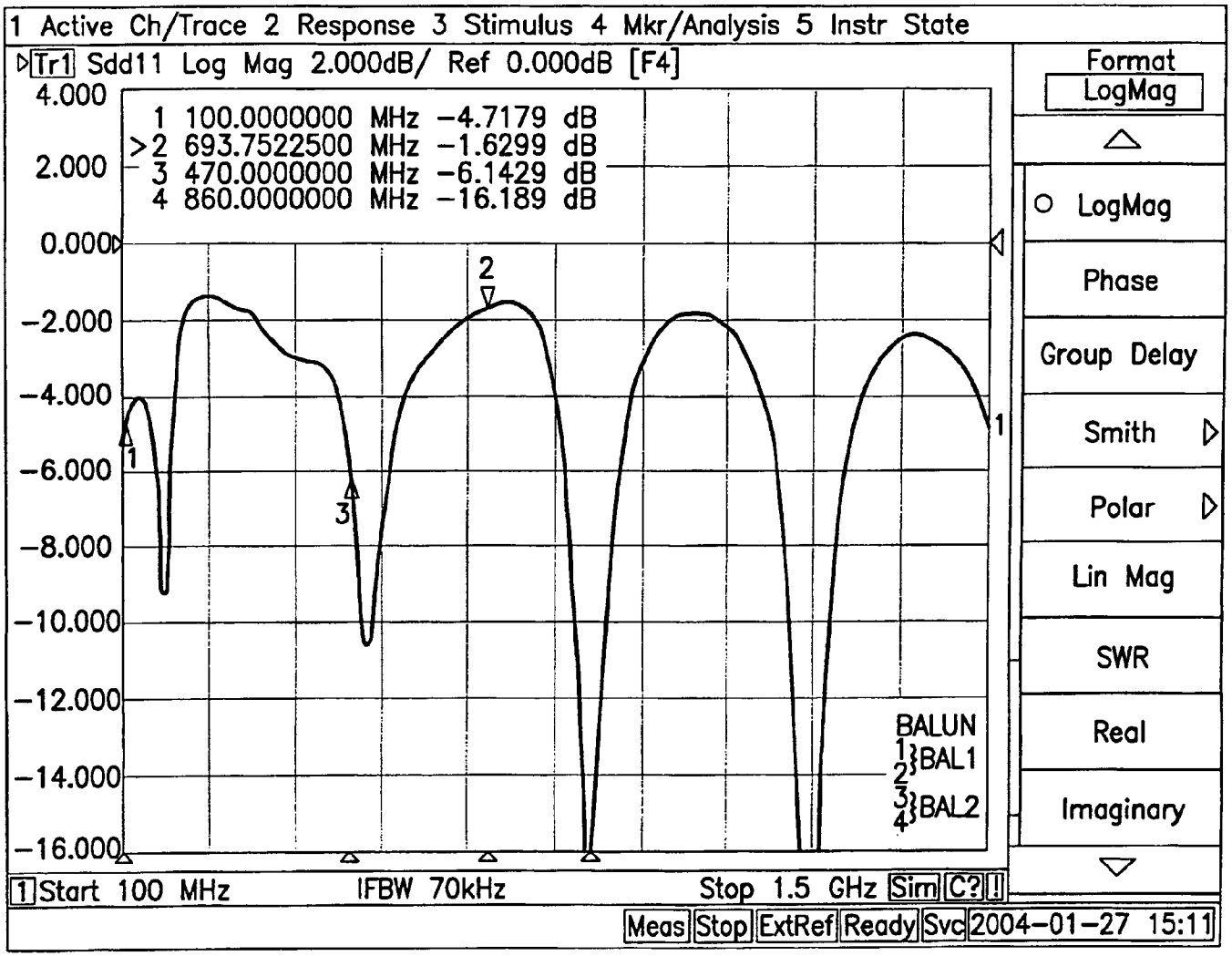
FIG. 3*a* is a computer generated plot of impedance matching S11 plot versus frequency for a loop antenna tested as shown in the block diagram of FIG. 3*b*.
Figure 3B:
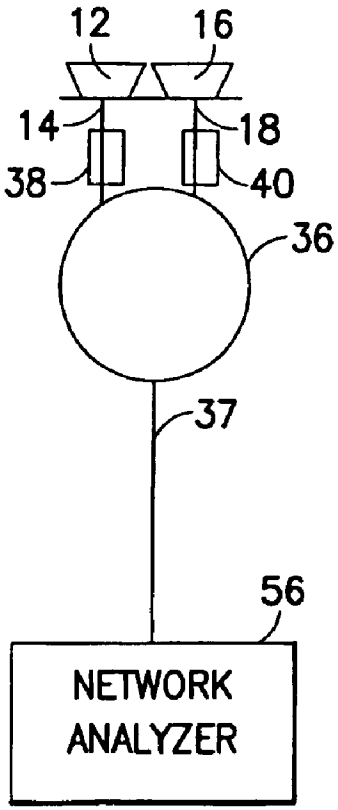

Performance data for the inventive loop antenna is next detailed. FIG. 3*a* is a computer-generated graph of antenna matching in dB along the vertical axis and frequency in Hz along the horizontal axis. The arrangement tested is as shown in FIG. 3*b*, similar to the block diagram of FIG. 1*b* but without the inductors and coupled to a network analyzer to capture the data plotted. The plotted data of FIG. 3*a* show the inventive loop antenna is in resonance at about 380 MHz intervals. This is due to the electrical length of the antenna loop section 36. As with each of FIGS. 3*a*, 4*a*, 5*a* and 6, specific coordinates for the numbered data points are listed at the upper left corner of the graph.

Figure 4B:
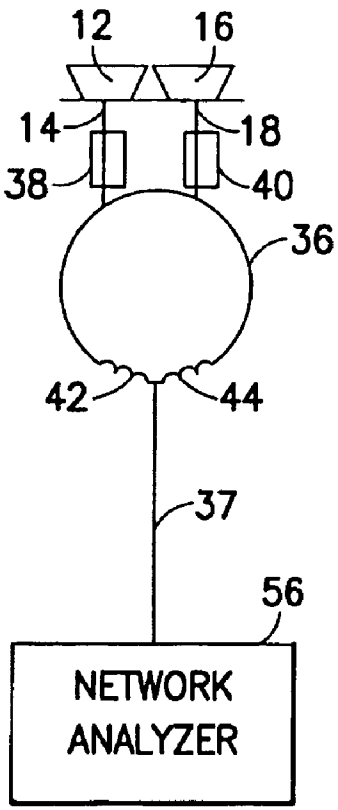
FIG. 4*a* is similar to FIG. 3*a*, but showing the plot for a loop antenna with matching inductors as depicted in the diagram of FIG. 4*b*.
Figure 4A:
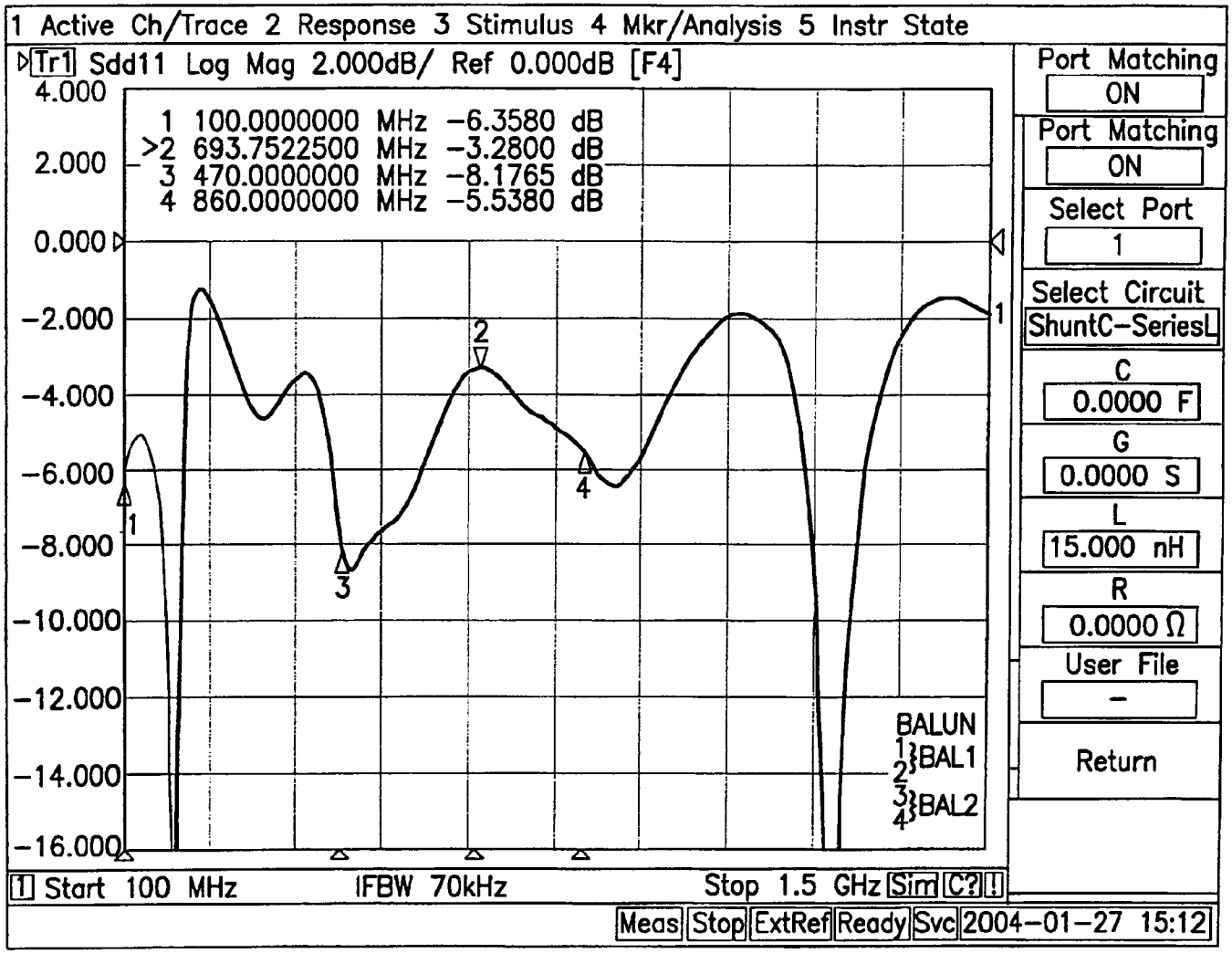

FIG. 4*a* is similar to FIG. 3*a* but for the arrangement of FIG. 4*b*, with inductors 42,44 imposed within the antenna loop section 36. Each inductor 42,44 defines an inductance L of 15 nH to match the circuitry of the model 7700 media device. The inventive antenna can be considered to act as an antenna when the power reflected (return loss) from the antenna circuit is less than about −4 dB. Comparing FIG. 4*a* against FIG. 3*a* shows that the inductors greatly improve performance in the frequency range graphed.

Figure 5B:
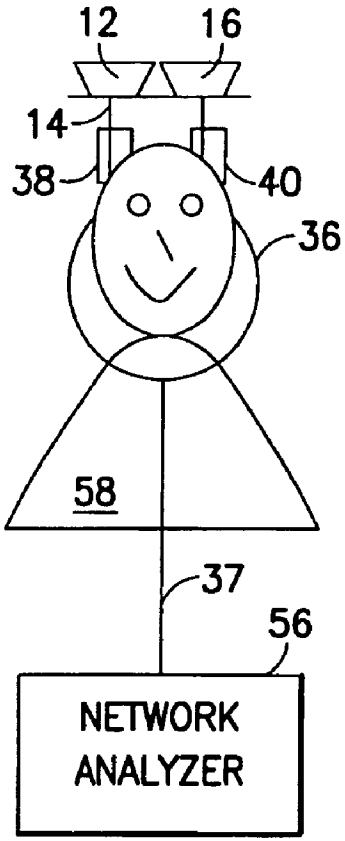
FIG. 5*a* is similar to FIG. 4*a* but showing the plot for the loop antenna having matching inductors being worn by a person as depicted in the diagram of FIG. 5*b*.
Figure 5A:
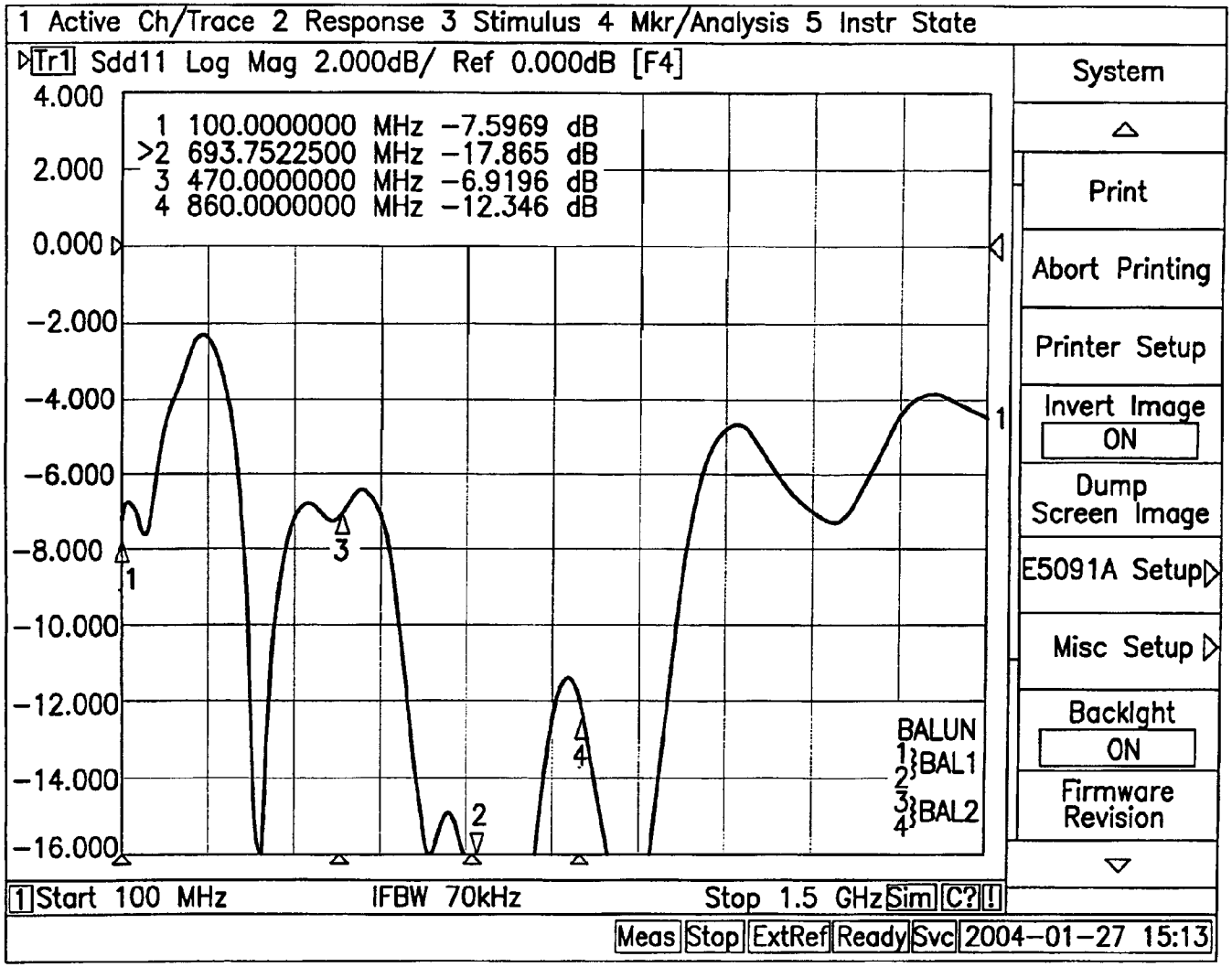

FIG. 5*a* is similar to FIG. 4*a*, but showing testing data for the apparatus of FIG. 5*b* tested while being worn by a user (though the earpieces 12, 16 are not depicted as within the user's ear canals as they were during testing). When the antenna loop section 36 is placed near or in contact with a person's body, antenna performance improves greatly due to what is termed a human body image effect or human inductance. Concisely, a loop antenna measures a magnetic field, and the human body conducts electricity. The entire spectrum between about 225 MHz to 1.5 GHz is at or below −4 dB, rendering the loop antenna effective over a very broad electromagnetic range. Adverse human health effects become a concern for radiating loop antennas operating above about 10 watts, so the present inventive headset should not be used as a radiating antenna, if at all, except at power levels below that threshold. Most preferably, the inventive antenna is used only as a receiving antenna and not as a radiating antenna. Such is consistent with the inventive headset's most advantageous use with DVB signals, which are transmitted over one-way channels to portable devices that may communicate back only along other non-DVB channels. While the loop antenna described herein may be particularly advantageous when used for reception of wireless DVB signals, it may also be used to receive AM, FM, or any other wireless RF signals.

The present invention further includes a method to convert radiofrequency signals to audible signals, audible being within the normal hearing range of persons. A RF signal is received at a loop antenna such as the antenna loop section 36 previously described. The RF signal is passed to a portable electronic device such as device 50 via a plug 30 that removably couples the loop antenna to the portable electronic device. Within the portable device, the RF signal is converted to an output signal. While complex, this conversion is well known in the art, such as AM and FM radio receivers, DVB receivers, mobile radiotelephones, and the like. The output signal is then sent to a transducer via the plug 30 and an audio wire such as the first 20 or second 22 conductors previously described. In accordance with the inventive aspects detailed above, at least a portion of the audio wire is mechanically bound to at least a portion of the loop antenna. The method then converts the output signal to an audible signal at the transducer.

Thus, while this invention has been particularly shown and described with respect to certain preferred and alternative embodiments thereof, it will be understood by those skilled in the art that changes in form and details may be made therein without departing from the scope and spirit of these teachings.

What is claimed is:

1. A device comprising:

a first earpiece with a first transducer;

a second earpiece with a second transducer a plug defining contacts for coupling to a portable audio device;

a first conductor coupled at one end to the first transducer and at an opposed end to at least one contact of the plug for providing a signal to the first transducer;

a second conductor forming a closed conductive loop, wherein a first segment of the loop is mechanically bound to a portion of the first conductor and electrically insulated therefrom, the portion spaced from the earpiece, the second conductor coupled to at least one other contact of the plug; and a third conductor coupled at one end to the second transducer and at an opposed end to a contact of the plug for providing a signal to the second transducer;

wherein a second segment of the loop is mechanically bound to a portion of the third conductor and electrically insulated therefrom, the portion of the third conductor spaced from the second earpiece, and further wherein the closed conductive loop is formed of the first segment of the loop, the second segment of the loop, and a conductive bridge disposed within a mechanical connector, wherein the mechanical connector is mechanically coupled to both the first and third conductors.

2. The device of claim 1, wherein the mechanical connector is slideable along at least one of the first and third conductors and the conductive bridge comprises a conductive contact between the first and second loop segments.

3. The device of claim 1, wherein the conductive bridge comprises a capacitive connection between the first and second loop segments.

4. The device of claim 1, wherein the mechanical connector is slideable along at least one of the first and third conductors so as to change an effective size of the closed conductive loop.

5. A device comprising:

an earpiece with a transducer;

a plug defining contacts for coupling to a portable audio device;

a first conductor coupled at one end to the transducer and at an opposed end to at least one contact of the plug for providing a signal to the transducer;

a second conductor forming a closed conductive loop, wherein a first segment of the loop is mechanically bound to a portion of the first conductor and electrically insulated therefrom, the portion spaced from the earpiece, the second conductor coupled to at least one other contact of the plug;

a conductive lead coupling the conductive loop to the at least one other contact of the plug; and a y-type coupler disposed between the conductive lead and the closed conductive loop.

6. The device of claim 5, further comprising a microphone disposed in the y-type coupler.

7. A device comprising:

an earpiece with a transducer;

a plug defining contacts for coupling to a portable audio device;

a first conductor coupled at one end to the transducer and at an opposed end to at least one contact of the plug for providing a signal to the transducer; and a second conductor forming a closed conductive loop, wherein a first segment of the loop is mechanically bound to a portion of the first conductor and electrically insulated therefrom, the portion spaced from the earpiece, the second conductor coupled to at least one other contact of the plug, wherein at least the first segment of the closed conductive loop comprises a conductive plastic.

8. A device comprising:

a first earpiece with a first transducer;

a second earpiece with a second transducer;

a plug defining contacts for coupling to a portable audio device;

a first conductor electrically coupling the first transducer to a contact of the plug, the first conductor comprising an upper portion adjacent to the earpiece and a lower portion between the upper portion and the plug;

a second conductor electrically coupled to the lower portion of the first conductor and forming therewith a closed conductive loop between the plug and the upper portion; and a third conductor electrically coupling the second transducer to a contact of the plug, the third conductor comprising an upper portion adjacent to the second earpiece and a lower portion between the upper portion of the third conductor and the plug;

wherein, the second conductor is further electrically coupled to the lower portion of the third conductor and forming therewith the closed conductive loop between the plug and the upper portions of both the first and third conductors, and further wherein the second conductor comprises a conductive bridge disposed within a mechanical connector such that the closed conductive loop is formed of the lower portion of the first and third conductors and the conductive bridge, further wherein the mechanical connector is mechanically coupled to both the first and third conductors.

9. The device of claim 8, wherein the mechanical connector is slideable along at least one of the first and third conductors and the conductive bridge comprises a conductive contact between the first and second loop segments.

10. The device of claim 8, wherein the conductive bridge comprises a capacitive connection between the first and second loop segments.

11. The device of claim 10, wherein the mechanical connector is slideable along at least one of the first and third conductors so as to change an effective size of the closed conductive loop.

12. A device comprising:

a first earpiece with a first transducer;

a second earpiece with a second transducer;

a plug defining contacts for coupling to a portable audio device;

a first conductor electrically coupling the first transducer to a contact of the plug, the first conductor comprising an upper portion adjacent to the earpiece and a lower portion between the upper portion and the plug;

a second conductor electrically coupled to the lower portion of the first conductor and forming therewith a closed conductive loop between the plug and the upper portion;

a third conductor electrically coupling the second transducer to a contact of the plug, the third conductor comprising an upper portion adjacent to the second earpiece and a lower portion between the upper portion of the third conductor and the plug; and a y-type coupler disposed along the lower portion of the first and third conductors and spaced from the plug, wherein, the second conductor is further electrically coupled to the lower portion of the third conductor and forming therewith the closed conductive loop between the plug and the upper portions of both the first and third conductors.

13. The device of claim 12, further comprising a microphone disposed in the y-type coupler.

14. A device comprising:

an earpiece with a transducer;

a plug defining contacts for coupling to a portable audio device;

a first conductor electrically coupling the transducer to a contact of the plug, the first conductor comprising an upper portion adjacent to the earpiece and a lower portion between the upper portion and the plug;

a second conductor electrically coupled to the lower portion of the first conductor and forming therewith a closed conductive loop between the plug and the upper portion; and an inductor disposed along the lower portion of the first conductor and within the closed conductive loop.

15. A device comprising:

an earpiece with a transducer;

a plug defining contacts for coupling to a portable audio device;

a first conductor electrically coupling the transducer to a contact of the plug, the first conductor comprising an upper portion adjacent to the earpiece and a lower portion between the upper portion and the plug; and a second conductor electrically coupled to the lower portion of the first conductor and forming therewith a closed conductive loop between the plug and the upper portion, in combination with a portable electronic device that comprises a receptacle for mating with the plug and at least one frequency selective filter to separate a wireless signal received at the closed conductive loop from an audio signal sent via the first conductor to the transducer.

* * * * *